US005186028A

United States Patent [19]

Kawase et al.

[11] Patent Number: 5,186,028

[45] Date of Patent: Feb. 16, 1993

[54] APPARATUS AND METHOD FOR CONTROLLING SELECTABLE KNITTING MACHINE MECHANISM

[75] Inventors: Yoji Kawase, Nishinomiya; Takao Shibata, Takatsuki, both of Japan

[73] Assignee: Precision Fukuhara Works, Ltd., Hyogo, Japan

[21] Appl. No.: 799,401

[22] Filed: Nov. 27, 1991

[51] Int. Cl.[5] ..... D04B 15/00; G05B 19/26

[52] U.S. Cl. ..... 66/232; 364/470

[58] Field of Search ..... 66/232; 364/470, 170, 364/565

[56] References Cited

U.S. PATENT DOCUMENTS

| | | | |
|---|---|---|---|
| 4,434,470 | 2/1984 | Thomas et al. | 364/565 |
| 4,494,203 | 1/1985 | Suzuki et al. | 364/470 |
| 4,763,492 | 8/1988 | Tibbals, Jr. | 66/232 |
| 4,891,588 | 1/1990 | Fujioka et al. | 364/565 X |
| 4,893,250 | 1/1990 | Sainen | 364/470 |
| 5,060,161 | 10/1991 | Sainen | 364/470 |

FOREIGN PATENT DOCUMENTS

| | | | |
|---|---|---|---|
| 0072065 | 5/1982 | Japan | 364/565 |
| 2160955 | 6/1990 | Japan | 364/470 |

*Primary Examiner*—Werner H. Schroeder
*Assistant Examiner*—John J. Calvert
*Attorney, Agent, or Firm*—Bell, Seltzer, Park & Gibson

[57] ABSTRACT

An apparatus for controlling a selectable knitting machine mechanism such as needle selection mechanism or a yarn feed changeover mechanism in a knitting machine having a rotating knitting machine component such as a needle cylinder, a cam box, or a dial is disclosed. The apparatus includes at least one sensor for detecting the rotational speed of the knitting machine component and generating a periodic signal therefrom. A control mechanism cooperates with the sensor and generates a control signal to the selectable knitting machine mechanism responsive to a predetermined trigger point of the periodic signal. The control mechanism includes a mechanism for delaying the predetermined trigger point when the rotational speed of the knitting machine component is relatively slow and for advancing the predetermined trigger point when the rotational speed of the knitting machine is relatively fast. The control mechanism includes a phase-control, frequency/voltage converter.

9 Claims, 2 Drawing Sheets

APPARATUS AND METHOD FOR CONTROLLING SELECTABLE KNITTING MACHINE MECHANISM

FIELD OF THE INVENTION

This invention relates to an apparatus for controlling a selectable knitting machine mechanism such as a needle selection mechanism or yarn feed changeover mechanism on a knitting machine.

BACKGROUND OF THE INVENTION

In a conventional circular knitting machine, the rotation of the needle cylinder and the concomitant movement and selection of the needles and yarn feed changeover mechanism are synchronously controlled to enable efficient knitting and to ensure high productivity. A sensor detects the rotational speed of the knitting machine and generates electrical signals having a strength proportional to the rotational speed of the knitting machine.

The generated electrical signals usually are transmitted based upon a predetermined trigger point corresponding to the time of sensing. For example, the sensor may sense cylinder speed at a select position of the needle cylinder and knitting needles. When the needle cylinder and needles are in this predetermined position the sensor senses the speed and generates a proportional electrical signal to the selection mechanism, which translates the electrical signals directly to mechanical movement of the mechanisms based upon the strength of the signal.

In older machines which operate at slower operating speeds, the electrical signal transmission based upon the timed trigger point did not adversely affect knitting machine efficiency. However, more modern machines are designed for high speed operation and include more yarn feeders for increased productivity. The conventional speed sensing and signal generating techniques are inadequate. The trigger point never changes whether the machine is slow or fast. At the moment when the cylinder and needle are in the predetermined position corresponding to the trigger point, the sensor generates the signal to the selection mechanism. During high speed operation of the knitting machine, the unmodified electrical transmission generates mechanical movement in the selection mechanism at the same speed whether the machine is slow or fast. As a result, during high speed knitting machine operation, the delay created by this process may cause the needle selection to become unstable. In extreme case, the errors in needle selection may cause a needle to break while impairing the texture of the knitted fabric.

SUMMARY OF THE INVENTION

It is therefore an object of the present invention to provide an apparatus and method for controlling the period of time in which sensor signals are transmitted to the selectable knitting machine mechanism such as the needle selection mechanism and yarn changeover feed mechanism of a knitting machine based upon the sensed speed of a knitting machine component such as the speed of the needle cylinder.

In accordance with the present invention there is disclosed an apparatus and method for controlling selectable knitting machine mechanisms such as needle selection mechanisms and yarn feed changeover mechanisms in a knitting machine having a rotating knitting machine component such as a needle cylinder, a dial, or a cam box. The invention provides for advancing or delaying a predetermined trigger point of a control signal based upon whether the sensed knitting machine component is relatively fast or relatively slow.

Sensing means senses the rotational speed of the rotating knitting machine component and generates a periodic signal in the preferred form of a sine wave. Control means cooperates with the sensing means and generates a control signal to the selectable knitting machine mechanism responsive to a predetermined trigger point of the periodic signal. The control means includes means for delaying the predetermined trigger point when the rotational speed of the knitting machine component is relatively slow and for advancing the predetermined trigger point when the rotational speed of the knitting machine is relatively fast. The periodic signal may be amplified.

The control means cooperating with the sensing means preferably includes a phase-control, frequency/-voltage converter. In a preferred embodiment, means in the form of a bar LED indicates the amount the trigger point is delayed or advanced.

BRIEF DESCRIPTION OF THE DRAWINGS

Some of the objects and advantages of the present invention having been set forth above, other objects and advantages will appear as the description proceeds when taken in conjunction with the accompanying drawings, in which.

DETAILED DESCRIPTION OF THE PREFERRED EMBODIMENT

Figure 1:
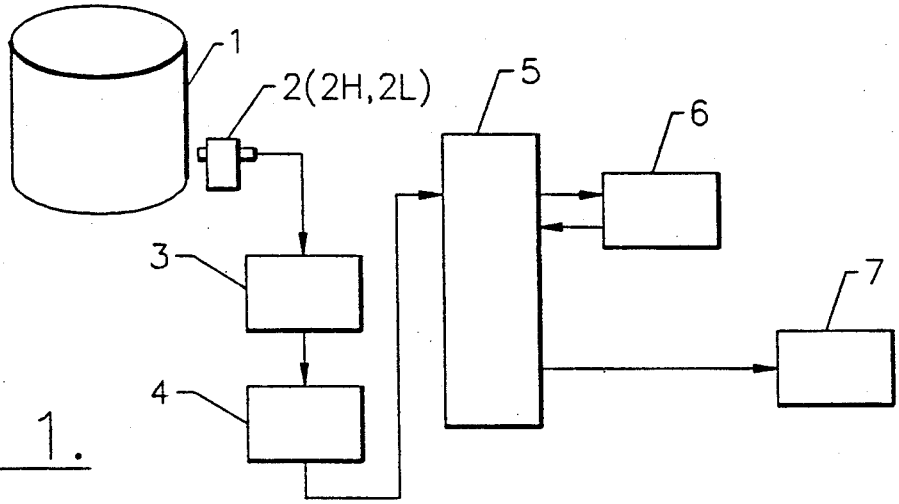
FIG. 1 is a block diagram of the invention.

Referring now to FIG. 1, there is illustrated a block diagram of the apparatus in accordance with the present invention. A rotating knitting machine component is illustrated as a needle cylinder 1, having a plurality of vertical grooves in which needles are positioned for vertical movement therein as the needle cylinder 1 rotates. Although the rotating knitting machine component is illustrated as a rotating needle cylinder, the component may also be a dial, cam box, or other rotating part depending on the particular design of the knitting machine. Rotational speeds of the machine vary depending on the size of the needle cylinder, and can range from 5 to 60 revolutions per minute.

Figure 2:
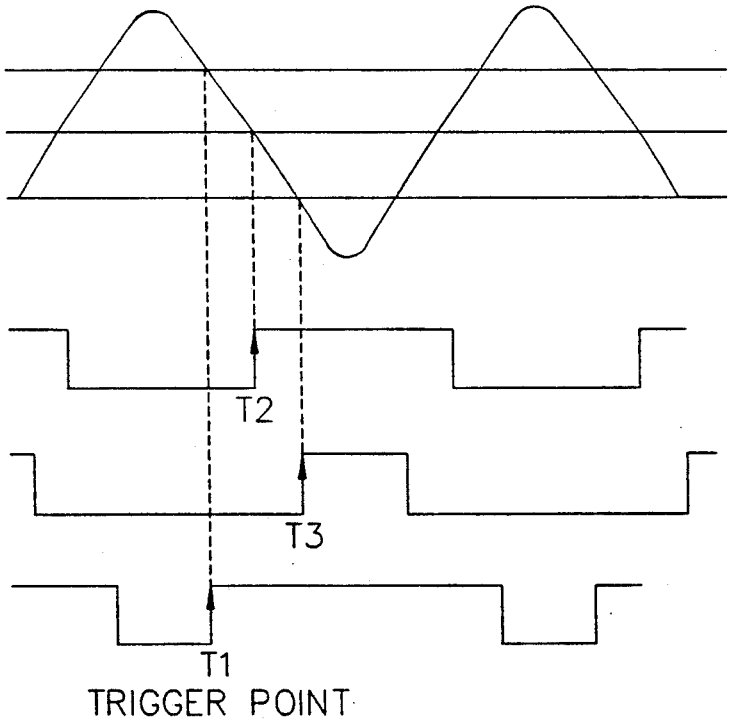
FIG. 2 shows a periodic waveform generated in accordance with the present invention and showing the advancing and retarding of the trigger point.

In the illustrated embodiment, a sensor detects the number of rotations of the needle cylinder. Depending on the particular sensor selected, the sensor detects speed of the cylinder by actually detecting the passing of the cylinder as it rotates past the sensor. In some designs, the sensor may detect the speed of the needle passing through a groove of the needle cylinder in which it slides, resulting in another means of measuring the speed the knitting machine operates. In any event, the sensor generates a minute signal representing the component speed in the form of an analog waveform, such as a sine waveform (FIG. 2).

After the signal is generated, the signal is amplified by amplifier 3, which may be a conventional op-amp known to those skilled in the art. Once the signal is amplified, the signal enters a phase control unit 4, for example an F/V (frequency/voltage) converter. As is known to those skilled in the art, with the converter, addition and subtraction are applied to the initial analog waveform to change the trigger point (FIG. 2). When the rotational speed of the machine component is relatively slow, the trigger point T3 is delayed, and when the rotational speed of the machine component is relatively fast, a trigger point T1 is advanced. In operation, as the frequency increases, the voltage level increases corresponding to the higher height on the analog waveform. As a result, the trigger point is automatically advanced based on operation of the frequency/voltage converter circuit. When the frequency is low corresponding to a slower speed of the rotating knitting machine component, the trigger point T3 is delayed. The three horizontal levels of T1, T2 and T3 indicate the voltages corresponding to the various frequencies of the fast, medium, and slow machine component revolution. The signal then is further amplified by amplifier 5, and then the signal is transmitted to the selectable knitting machine mechanism 7 or transmitted through the knitting machine controller 6 to the mechanism 7.

Figure 3:
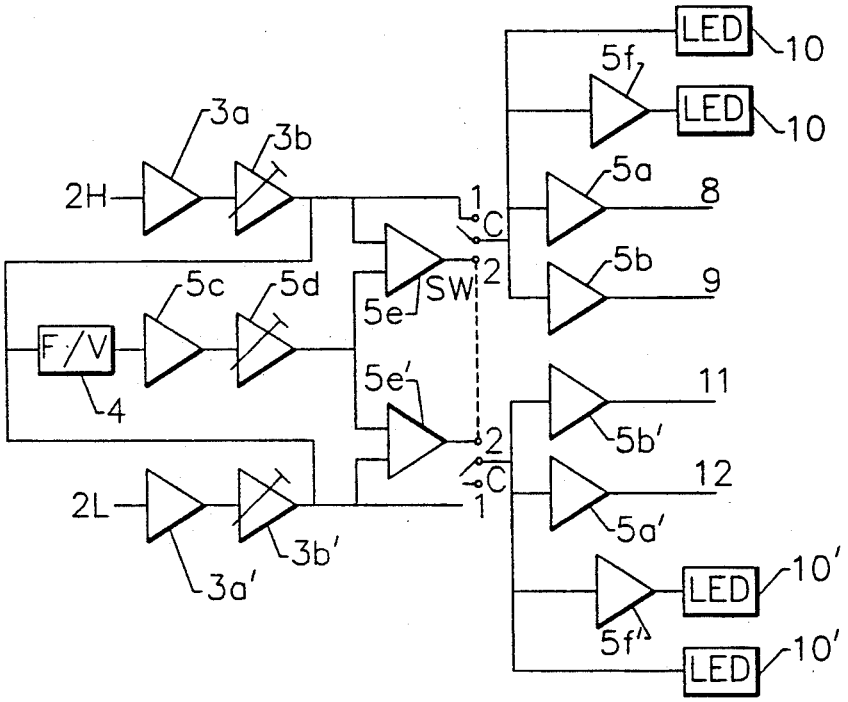
FIG. 3 is a schematic electrical diagram showing major components of the invention.

Referring now to FIG. 3, a schematic circuit diagram of the present invention is shown. As illustrated, two sensors 2H and 2L are shown for detecting the speed of the needle cylinder 1. Because the signal transmission route from the sensors 2H and 2L are substantially the same, the description of one side only is described, and the same path description applies to the other side, which is noted with numerals having prime notation.

The generated signals are amplified in operational amplifiers 3*a* and 3*b*. The circuit also includes changeover switches SW to enable changeover of the circuit from one electrical path 1 to another electrical path 2. When the switch SW is switched to side 1, a signal is outputed to gate 8 through an operational amplifier 5*a*. Similar information may be used as an output for a sensor 9 through an operational amplifier 5*b*. The sensor 9 may be added to sense other machine components, which may be rotating.

When the switch SW is switched to side 2, the F/V (frequency/voltage) converter 4 is operative in the circuit and controls the phase of the analog periodic wave. The converter's 4 operative function is applied to the analog waveform to change the trigger point as shown in FIG. 2.

The signals are output to a gate 8 after they are amplified by the operational amplifiers 5*c*, 5*d*, 5*e*, and 5*f*. Similar information may be used as a signal for another sensor 9 through the operational amplifier 5*b*. Performance of the analog waveform can visually be confirmed by a level indication mechanism 10, such as a bar LED. As shown in FIG. 3, looking on the side of the sensor 2L, signals from the gate 12 and sensor 11 may be outputed through similar routes.

The signals outputed to the gates 8 and 12 and sensors 9 and 11 are transmitted to the selection mechanism 7 such as the needle selection mechanism, or through the controller 6 to the selection mechanism 7.

In accordance with the present invention, rotation of the speed of the rotating knitting machine component such the needle cylinder, dial, or cam box is detected with the sensors, and the analog waveform generated and amplified. The frequency/voltage converter controls the waveform and the trigger point is delayed when the rotational speed of the knitting machine component is relatively slow, and the trigger point is advanced when the knitting machine component is relatively fast. Thus, the signals are controlled based on the relative speed of the knitting machine, resulting in more efficient operation, needle selection, yarn feed changeover, and better knit texture.

In the drawings and specification, there has been set forth a preferred embodiment of this invention, and even though specific terms are used, they are used in a generic and descriptive sense only and not for purposes of limitation.

That which is claimed is:

1. In a knitting machine having a rotating knitting machine component that rotates at a rotational speed, and a selectable knitting machine mechanism including a needle selection mechanism and a yarn feed changeover mechanism, an apparatus for controlling said selectable knitting machine mechanism comprising:

said rotating knitting machine component cooperating with a sensing means for sensing said rotational speed and for generating a periodic signal therefrom; and control means cooperating with said sensing means for generating a control signal to said selectable knitting machine mechanism responsive to a predetermined trigger point of said periodic signal, said control means including means to delay said predetermined trigger point when said rotational speed of the rotating knitting machine component is relatively slow and to advance said predetermined trigger point when said rotational speed of the knitting machine is relatively fast.

2. An apparatus according to claim 1 including means for amplifying the periodic signal.

3. An apparatus according to claim 1 wherein the control means cooperating with the sensing means includes a phase-control, frequency/voltage converter.

4. An apparatus according to claim 1 including means for indicating the amount the trigger point is delayer or advanced.

5. An apparatus according to claim 1 wherein the means for indicating the amount the trigger point is delayed or advanced comprises a bar LED.

6. A method for controlling a selectable knitting machine mechanism including a needle selection mechanism or yarn feed changeover mechanism in a knitting machine having a rotating knitting machine component that rotates at a rotational speed, comprising the steps of:

sensing said rotational speed of said rotating knitting machine component, generating a periodic signal form the sensed rotation, advancing or delaying a predetermined trigger point of the periodic signal so that the trigger point is advanced when the rotational speed of the rotating knitting machine component is relatively fast, and the trigger point is delayed when the rotating knitting machine component is relatively slow, and generating a control signal to the selectable knitting machine mechanism responsive to the trigger point of the periodic signal.

7. A method according to claim 6 including the step of amplifying the periodic signal.

8. A method according to claim 6 including the step of processing the periodic signal in a frequency/voltage converter.

9. A method according to claim 6 including the step of displaying the amount of trigger point advance or delay on a bar LED.

* * * * *